United States Patent [19]

Braun

[11] 4,103,198

[45] Jul. 25, 1978

[54] ROTATING ANODE X-RAY TUBE

[75] Inventor: Martin Braun, Stamford, Conn.

[73] Assignee: Raytheon Company, Lexington, Mass.

[21] Appl. No.: 813,043

[22] Filed: Jul. 5, 1977

[51] Int. Cl.[2] ..... H01J 35/08

[52] U.S. Cl. ..... 313/60; 313/330

[58] Field of Search ..... 313/60, 330

[56] References Cited

U.S. PATENT DOCUMENTS 3,842,305 10/1974 Braun ..... 313/60

*Primary Examiner*—Rudolph V. Rolinec

*Assistant Examiner*—Darwin R. Hostetter

*Attorney, Agent, or Firm*—Harold A. Murphy; Joseph D. Pannone; John T. Meaney

[57] ABSTRACT

An x-ray tube including an evacuated envelope having therein a rotatable anode target comprised of a cup-shaped body having a sloped inner wall provided with an annular groove wherein a plurality of pinlike members form an x-ray generating focal track, the members interfitting with the groove at their upper ends and being retained in place at their lower ends by a circumferentially extending removable band or spaced retainers enabling the members to be more easily assembled and retained in place.

18 Claims, 6 Drawing Figures

FIG. 2
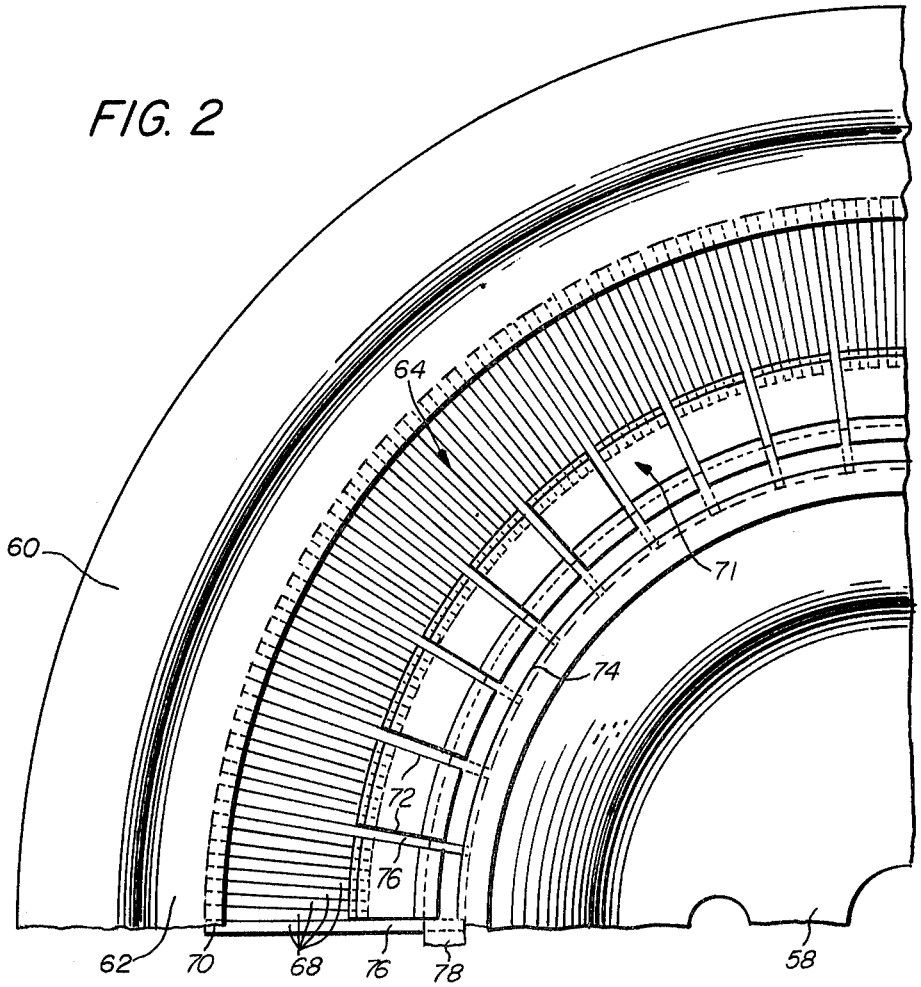
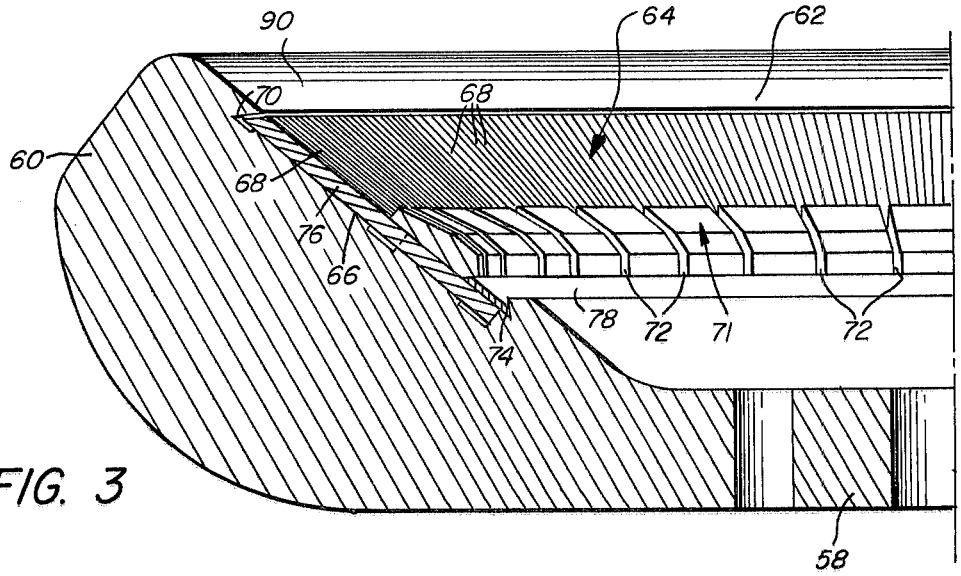
FIG. 3

ROTATING ANODE X-RAY TUBE

BACKGROUND OF THE INVENTION

A novel high power x-ray tube having improved heat dissipation and compensation characteristics is shown and described in U.S. Pat. No. 3,842,305, assigned to the same assignee as the present invention. This tube comprises an evacuated envelope wherein a rotatable cup-shaped anode target has a sloped inner wall surface provided with an annular focal track from which x-rays are emitted when the track is bombarded by electrons.

The focal track comprises an annular channel in the sloped wall surface, which channel contains a plurality of pin-like target members disposed in side-by-side relation throughout the inner circumference of the target and extending parallel with each other in the direction of the width of the channel.

Disposed in operative spaced relation to a portion of the focal track is an electron emitting cathode from which electrons are electrostatically beamed onto the adjacent aligned portion of the focal track. As a result, the bombardment of the focal track by the electron beam causes the target members to emit x-radiation which passes out of the tube envelope through an exit window therein.

During operation of the tube, the anode is rotated, causing the target members to be sequentially moved through the electron beam. Thus, the heat generated by electron bombardment of the target members is distributed throughout the focal track and underlying body of the target.

The upper ends of the target members are, in known tube structures, interfitted beneath an overlying lip on the target body, and the lower ends are retained within the groove by a cup which is mounted by its base on the base of the target with its upwardly extending annular side wall being positioned in overlying relation to the lower edge of the groove and to the lower ends of the target members. Thus, the members are snugly retained in place within the groove, the dimensions of which are such that the members are permitted thermal expansion.

It will be apparent that during operation of the tube, centrifugal forces will urge the individual target members into close engagement with the bottom of the groove. This will aid in the transfer of heat from the members to the target body.

However, it has been found that dimension tolerances are critical and unless the parts of the device are precisely manufactured the target members may not properly engage the bottom of the groove for best thermal conductivity, or actually may become disengaged from the groove. Further, the inner retaining cup is fragile, usually being made of good thermal absorption material such as graphite, and is easily damaged or broken, thus possibly leaving particles in the tube which are detrimental to proper and efficient operation of the tube. The cup, still further, is a radiation barrier which often prevents complete outgassing during processing of the tube.

SUMMARY OF THE INVENTION

The above and other objections to prior art x-ray tubes of the character described are overcome by the provision of novel means for retaining the target members within the groove in the target while permitting easy assembly of members within the groove.

This is achieved, according to this invention, by providing the target with an inclined inner wall in which is located an annular groove and with a raised annular land extending circumferentially of the wall along the lower edge of the groove with a lip on the land overlying the groove so as to retain one end of short pinlike target members within the groove. The land is provided at intervals along its length with slots communicating with the underlying groove whereby the short target members may be inserted into the groove.

The groove is provided with radially downwardly extending spaced short slots into which respective long pinlike target members may be inserted when the remainder of the groove is filled with short members. A second channel or groove parallel with and spaced from the lower edge of the first groove is provided below the lower edge of the land and said slots extend into the second channel together with the adjacent ends of the longer pin elements. Into this second channel is inserted a strip or band of thin metal such as tantalum or carbon which overlies the lower ends of the long target members, holding them in place.

The strip or band may be broken up into separate segments or clips, each disposed in the second channel below a respective slot in the land for retaining the individual respective long members in place.

Thus, all parts of the target structure may be easily out-gassed, and no fragile elements are utilized, while the array of target members is efficiently supported in position of use.

BRIEF DESCRIPTION OF THE DRAWINGS

The foregoing and other objectives of this invention will become apparent frrom the following description taken in connection with the accompanying drawings wherein

FIG. 2 is an enlarged plan view of a segment of the target of the tube shown in FIG. 1;

FIG. 3 is an enlarged vertical sectional view of the target segment shown in FIG. 2;

DESCRIPTION OF THE PREFERRED EMBODIMENT

Figure 1:
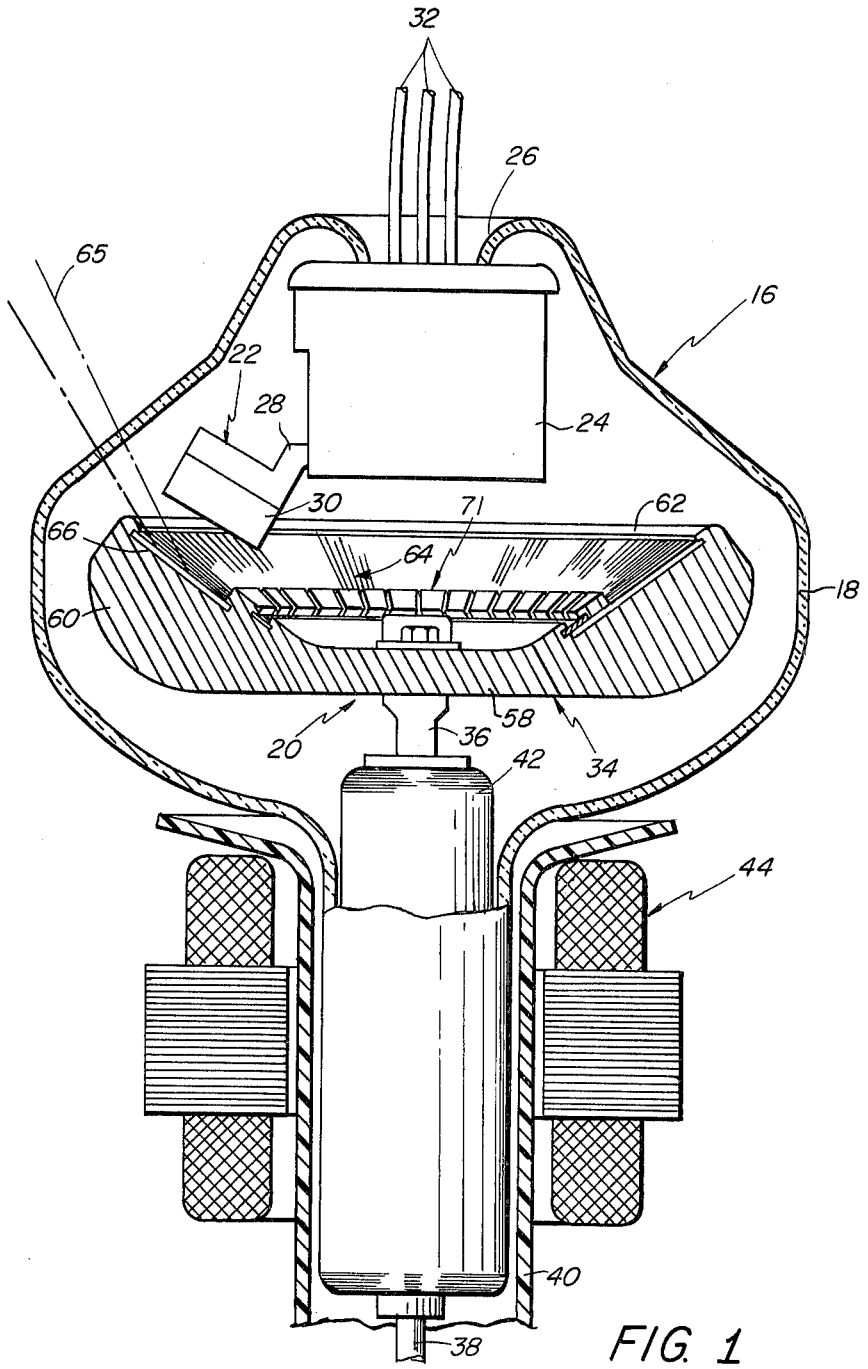
FIG. 1 is an axial sectional view of an x-ray tube embodying the invention.

Referring to the drawings, the x-ray generator embodying the invention is shown in FIG. 1 and comprises an x-ray tube 16 of the rotating anode type which includes a dielectric envelope 18 in which is supported an anode 20 and a cathode 22. The cathode 22 includes a supporting cylinder 24, one end of which is sealed to a reentrant end portion 26 of the envelope. On the inner end of cylinder 24 is mounted one end of a transversely extending angled support bracket 28, in the free end of which is located a cathode head 30. The cathode head 30 contains an electron-emitting filament to which a suitable electrical potential is applied through leads 32 extending externally of the tube through cylinder 24 to a cable termination (not shown).

The opposite end of the envelope 18 carries the anode 20 which includes a target assembly 34 mounted on one end of a rotor shaft 36 extending from a rotor 38 rotatably located in a neck portion 40 of the envelope. The rotor carries a skirt 42 bolted thereto, and the assembly is adapted to rotate rapidly when the tube is mounted in suitable inductive means 44 surrounding the neck 40 when the inductive means is energized. The lower end of rotor 38 is bolted or otherwise secured to the adjacent end of the envelope neck portion 40.

In accordance with this invention, the anode target assembly 34 comprises a cup-shaped heat sink member 58 having a transversely extending base portion with a substantially cylindrical upstanding circumferential wall 60 having an inclined inner surface 62 directed outwardly and upwardly. Surface 62 has affixed to it or in it an annular ribbon-like target member 64 which extends throughout the circumference of the surface 62. The exposed surface of the target 64 is directed toward the cathode head 30 so that an electron beam from the cathode may be made to impinge upon the target. As is well known in x-ray tubes, the anode is rotated so as to move the target in a circular path through the electron beam. As a result, x-rays are generated in the target and pass out through the dielectric envelope wall as a beam 65.

The anode target member 64 is in the form of a ring made of suitable high atomic number material, such refractory materials as tungsten or tungsten-rhenium or molybdenum being particularly suitable.

The target of conventional x-ray tubes usually comprises the entire anode disc or is a metallurgically deposited coating upon a suitable backing of high thermal capacity material. For example, the entire target of conventional x-ray tubes may be made of tungsten, or a target backing of tungsten, graphite, molybdenum or the like may carry on its surface a focal target ring of a deposited or metallurgically bonded material such as tungsten or tungsten-rhenium alloy.

The target 64 is made as a member seperate from the heat sink member 58, and is itself made up of a number of separate elements. With the improved heat transfer characteristics achieved by this invention, the target member 64 may be a ring which lies upon the adjacent surface 62 of the heat sink wall portion 60. Such a ring may be closely fitted onto the surface 62 or, preferably, will be disposed within a closely interfitting groove or channel 66 in surface 62.

The important factor achieved is that this construction utilizes natural centrifugal forces available with rotating systems to improve the heat-conductive relation between the x-ray generating metal and the heat sink material. Therefore, when the target is bombarded by the electrons from the cathode, the resultant heat generated within the target material will easily be conducted into the higher heat capacity material of the heat sink.

The wall 60 of the heat sink 58 is relatively thick in order to provide suitable mass for efficient heat collection. The target ring 64, however, need be only of a width corresponding to or slightly larger than the length of the focal spot formed at the area of impingement of the electron beam. The base portion of the heat sink 58 adjacent the rotor shaft 36 is relatively thin to aid in preventing any substantial amounts of heat from passing from the wall 60 into the shaft 36 and associated bearing structure (not shown).

In the preferred embodiment of the invention the target ring 64 is made up of several separate elements located in closely adjacent side-by-side relation. As shown in FIG. 3, for example, these elements may comprise a number of elongated pin- or rodlike elements 68 which are disposed within the groove 66 formed throughout the inner circumference of the wall 60. The elements 68 extend parallel with each other in the direction of the width of the slot and are held in place by a lip 70 which overlies the adjacent end portions of the elements 68. The active surface of the target ring, therefore, will be recessed beneath surface 62 an amount which corresponds to the thickness of the elements 68, in one embodiment of the invention. The elements 68 will, of course, preferably be slightly wider at their upper ends so as to compensate for the inclined geometry.

It will be apparent that centrifugal forces will insure firm physical engagement of the target elements 68 with the wall 60 of the heat sink member 58. As rotational speeds are increased, the centrifugal forces pressing the elements against the heat sink will correspondingly increase. Also, when the elements 68 become hotter they become more ductile, and consequently will more snugly contact the heat sink.

It is important that the heat sink be constructed of a material which not only has higher thermal storage capacity per unit weight than the material of the target but also has inherent strength sufficient to withstand deformation at the high temperatures which are employed. Boron carbide, graphite, and pyrolytic graphite exhibit excellent strength characteristics for this purpose.

It will be seen from FIGS. 2 and 3 that the anode surface 62 is provided with an annular raised land 71 beneath which the lower edge of the groove 66 extends. Thus, there is a portion of the raised land 71 which overlies the lower ends of the arrays of pin elements 68. It will be obvious, however, that it would be extremely difficult to tightly pack a complete set of such pin elements 68 throughout the entire length of the groove or slot 66. Therefore, at intervals throughout its length the annular land 71 is provided with spaced slots 72 which are of a depth which extends to the slot 68. The surface 62 there is provided a second annular channel or groove 74 which is located adjacent the inner edge of land 71 and intersects with the slots 72 and has sides which divergently incline. Thus, in assembling a focal track, a number of pinlike elements 68 are inserted through slots 72 into annular groove 68 and slid under the overlying portions of the annular land 71.

Then, the spaces between such elements 68 are closed by inserting longer pin elements 76 into the slots 72 and groove 66. These longer elements 76 will interfit beneath the lip 70 at their upper ends in the same manner as the shorter pins 68 and their opposite ends will project into the second groove 74. However, while the shorter pins are now prevented from being displaced by the overlapping lips on the land 71 and by the longer pins, the longer pins 76 are free at their lower ends to become dislocated. Therefore, to prevent this, a ribbon 78 of metal such as tantalum or molybdenum, or of graphite, for examples, is pressed into the lower annular groove 74 to overlie the adjacent ends of the longer pins 76.

Figure 5:
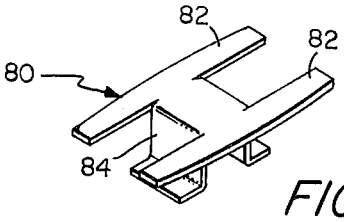
FIG. 5 is an isometric view of a pin-retaining clip.
Figure 6:
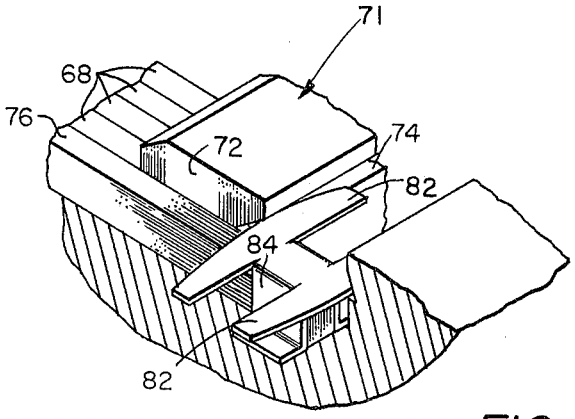
FIG. 6 is a fragmentary view partly in section showing the pin-retaining clip in position of use.

In a modified structure, the longer pin elements 76 may be held in place by short members or clips which may be formed by cutting the ribbon retainer 78 into small portions, one for each longer pin element or for a few of the longer pin elements, as desired. As shown in FIGS. 5 and 6, the retaining means is a specially fabricated clip 80 having a generally H-shaped configuration, with the outer edges of the long arms 82 being located within the groove or channel 74 and overlying the adjacent end of a respective longer pin element 76. The clip, which may be stamped out of a suitable resilient material such as tantalum or molybdenum has a pair of downwardly turned spaced flange portions 84 which engage opposite sides of the adjacent portion of the long pin element, which flange portions are each provided with an outwardly directed portion 86 seated on the bottom of the groove base 88. The clips 80 are thus yieldably held in position to retain the long pin elements in place.

Figure 4:
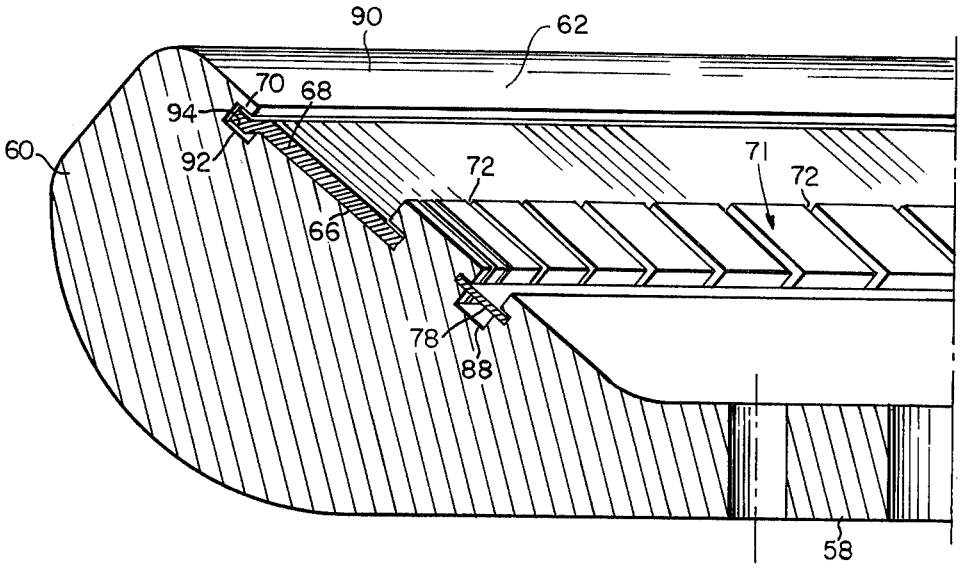
FIG. 4 is a view similar to FIG. 3 showing a modification thereof.

It will be seen that alternative means may be provided for retaining the upper ends of the pin elements in place so that the exposed surfaces of the elements may be flush with the adjacent upper surface of the anode or may be recessed therebelow. In the structure shown in FIG. 3 the pin elements 76 are flush with adjacent anode surface 90. However, the pin elements 68 in the FIG. 4 structure lie below the plane of anode surface 90 and this is achieved as by providing the groove, slot or channel 68 with a portion 92 which is more deeply located than the major portion of the bottom of the groove. Thus, the pin elements may be provided with angled portions 94 for seating within the deepened portion 92 of the groove. In such a case the overlying lip 70 need not be beveled as in the FIG. 3 structure.

From the foregoing it will be apparent that the objectives of this invention are achieved in the x-ray tube described wherein the pin elements are assembled with an anode body and retained in place by novel means which enables easier and faster assembly, which does not require the critical tolerances of prior devices, eleminates radiation barriers, and can be completely outgassed during tube processing.

It will be apparent, however, that various modifications and changes may be made by those skilled in the art without departing from the spirit of the invention as expressed in the accompanying claims. Therefore, all matter shown and described is to be interpreted as illustrative and not in a limiting sense.

What is claimed is:

1. A target for rotating anode x-ray tubes comprising an annular body adapted to be rotated about its axis and having one surface inclined to the horizontal and having an annular groove in said inclined surface, and a focal track ring disposed on said inclined surface of said body, said ring comprising an array of pinlike elements located within said groove and extending in side-by-side relation throughout the length of the groove and adapted to be urged toward the bottom surface of the groove by centrifugal force during rotation of the body, said body having an integral annular raised land portion along the inner side of the groove and overlying one end of a majority of said elements, and said body having an integral lip portion which overlies the other ends of said elements.

2. A target as set forth in claim 1 wherein a number of said elements are longer than the majority thereof and are interspaced at predetermined intervals therewith, said longer elements each extending radially beyond one end of the array of shorter elements, and removable means carried by said body in overlying relation to the projecting ends of said longer elements.

3. A target as set forth in claim 2 wherein said body is provided with a channel extending annularly parallel with and spaced from one side of said groove, the projecting ends of said longer elements extending into said channel, and said removable means being located in said channel.

4. A target as set forth in claim 3 wherein said land portion has spaced radially extending slots therethrough and interconnecting said groove and channel, said slots providing means whereby said pinlike elements may be inserted into said groove.

5. A target as set forth in claim 3 wherein said removable means is a resilient element interfitting with the sides of said channel.

6. A target as set forth in claim 3 wherein said removable means is a ring-like element.

7. A target as set forth in claim 3 wherein said removable means is a yieldable clip for each respective element, said clips each having edge portions yieldably engaging the sides of the channel and side portions engaging opposite sides of the respective longer element.

8. A target as set forth in claim 4 wherein said land portion is disposed on the side of the groove nearest said axis.

9. A target as set forth in claim 8 wherein said channel is disposed at the side of the groove nearest said axis, and the land portion extends therebetween.

10. An x-ray tube comprising an envelope, an anode structure rotatably supported in the envelope, a cathode structure supported within the envelope in spaced relation to the anode structure, said anode structure including an axially extending shaft, a target supported by said shaft for rotation therewith, and a connecting portion securing said target to the shaft, the target comprising an annular wall portion extending angularly from the periphery of the connecting portion and having one surface inclined to the horizontal and having an annular groove in said inclined surface, and a focal track ring disposed on said inclined surface of said wall portion, said ring comprising an array of pinlike elements located within said groove and extending in side-by-side relation throughout the length of the groove and each extending substantially radially of the target and adapted to be urged toward the bottom surface of the groove by centrifugal force during rotation of the target, said wall portion having an integral raised annular land portion along the inner side of the groove and overlying one end of a majority of said elements, and said wall portion having an integral lip along the opposite side of the groove, which lip overlies the other ends of said elements.

11. An x-ray tube as set forth in claim 10 wherein a number of said elements are longer than the majority thereof and are interspersed at predetermined intervals therewith, said longer elements each extending radially beyond one end of the array of shorter elements, and removable means carried by said wall portion in overlying relation to the projecting ends of said longer elements.

12. An x-ray tube as set forth in claim 11 wherein said wall portion is provided with a channel extending annularly parallel with and spaced from one side of said groove, the projecting ends of said longer elements extending into said channel, and said removable means being located in said channel.

13. An x-ray tube as set forth in claim 12 wherein said land portion has spaced radially extending slots therethrough and interconnecting said groove and channel, said slots providing means whereby said pinlike elements may be inserted into said groove.

14. An x-ray tube as set forth in claim 12 wherein said removable means is a resilient element interfitting with the sides of said channel.

15. An x-ray tube as set forth in claim 12 wherein said removable means is a ringlike element.

16. An x-ray tube as set forth in claim 12 wherein said removable means is a yieldable clip for each respective element, said clips each having edge portions yieldably engaging the sides of the channel and side portions engaging opposite sides of the respective longer element.

17. An x-ray tube as set forth in claim 13 wherein said land portion is disposed on the side of the groove nearest said axis.

18. An x-ray tube as set forth in claim 17 wherein said channel is disposed at the side of the groove nearest said axis, and the land portion extends therebetween.

* * * * *